US006666726B2

(12) United States Patent
Koch

(10) Patent No.: US 6,666,726 B2
(45) Date of Patent: Dec. 23, 2003

(54) ELECTRICAL CONNECTOR ASSEMBLY

(75) Inventor: Richard M. Koch, Wakefield, MA (US)

(73) Assignee: Tru Corporation, Peabody, MA (US)

( * ) Notice: Subject to any disclaimer, the term of this patent is extended or adjusted under 35 U.S.C. 154(b) by 0 days.

(21) Appl. No.: 10/232,832

(22) Filed: Aug. 30, 2002

(65) Prior Publication Data

US 2003/0060088 A1 Mar. 27, 2003

Related U.S. Application Data

(63) Continuation-in-part of application No. 09/919,099, filed on Jul. 31, 2001, now Pat. No. 6,443,778.
(60) Provisional application No. 60/221,744, filed on Jul. 31, 2000.

(51) Int. Cl.[7] ..... H01R 13/64
(52) U.S. Cl. ..... 439/680; 439/320
(58) Field of Search ..... 439/680, 320, 439/681, 321, 322, 323, 312, 307, 308, 309, 313–319, 310, 311, 306, 256

(56) References Cited

U.S. PATENT DOCUMENTS 3,594,700 A * 7/1971 Nava et al. ..... 439/315
3,609,636 A * 9/1971 Kubin et al. ..... 439/277
3,663,926 A * 5/1972 Brandt ..... 439/321
3,711,815 A * 1/1973 Pierce et al. ..... 439/319
3,808,580 A * 4/1974 Johnson ..... 439/321
3,917,373 A * 11/1975 Peterson ..... 439/321
4,407,529 A * 10/1983 Holman ..... 285/82
4,500,153 A * 2/1985 Mattingly et al. ..... 439/313
4,676,573 A * 6/1987 Norman ..... 439/318
5,100,341 A * 3/1992 Czyz et al. ..... 439/447
5,145,394 A * 9/1992 Hager ..... 439/321
6,152,753 A * 11/2000 Johnson et al. ..... 439/321
6,443,778 B1 * 9/2002 Koch ..... 439/680

* cited by examiner

*Primary Examiner*—Ross Gushi
(74) *Attorney, Agent, or Firm*—Grossman, Tucker, Perreault & Pfleger, PLLC

(57) ABSTRACT

An electrical connector assembly including a plug portion and a receptacle portion. The plug and receptacle portions include corresponding keying features. The plug portion includes a spring for biasing a coupling nut way from the receptacle when the plug and receptacle are mated. The spring force assists in disengaging a keyed connection between the plug and receptacle.

12 Claims, 4 Drawing Sheets

ELECTRICAL CONNECTOR ASSEMBLY

CROSS REFERENCE TO RELATED APPLICATIONS

The present application is a continuation-in-part of U.S. application Ser. No. 09/919,099, filed Jul. 31, 2001 now U.S. Pat. No. 6,443,778, which claims the benefit of U.S. provisional application Ser. No. 60/221,744, filed Jul. 31, 2000, the teachings of which applications are incorporated herein by reference.

FIELD OF THE INVENTION

The present invention relates in general to electrical connectors, and in particular to an electrical connector assembly having keyed components for preventing inadvertent connection of a plug with an incorrect receptacle.

BACKGROUND

Whenever two or more plug and receptacle pairs, each comprising the subassemblies of a connector arrangement, are located adjacent to each other, there is always the possibility that the various connector plugs may not be mated to the receptacles for which they were intended, through human error. This is particularly true where these connections are located in difficult access positions. If the connectors are of the single cable coaxial type, for example, there is nothing about the connector subassemblies (plug and receptacle halves) themselves that would prevent mismating, since the corresponding subassemblies are frequently identical parts.

Although some coaxial connectors are "polarized", these are limited to situations where there are just two coaxial connections to be considered at any one location. Even in multi-pin connectors, any "keying" provided is usually for rational alignment purposes and cannot prevent the inadvertent mismating of identical plug and receptacle connector subassemblies.

There is, therefore, a need in the art for electrical connectors that are configured to efficiently and reliably prevent inadvertent connections of a plug into an incorrect receptacle.

SUMMARY OF THE INVENTION

A connector assembly consistent with the invention includes a plug portion and a receptacle portion. The plug portion includes a coupling nut and a separate key rotatably secured to an interior surface of the coupling nut. The key includes a first flat surface and a projection that extends from an interior surface of the key. The receptacle portion includes an outer shell and threads for meshingly engaging corresponding threads on the plug upon mating of the plug to the receptacle. The outer shell includes a second flat surface and a raceway. The second flat surface is positioned to align with the first flat surface, and the raceway is dimensioned to receive the projection. The projection is maintained in the raceway upon mating of the plug with the receptacle through meshing engagement of the threads on the receptacle with the threads on the plug.

In another embodiment, a connector assembly consistent with the invention includes a keyed plug and receptacle. The plug has a coupling nut with at least one plug keying feature at a mating end of the plug. The plug includes a spring configured for biasing the coupling nut away from a mating end of the plug. The receptacle includes threads for meshingly engaging corresponding threads on the plug upon mating of the plug to the receptacle. The receptacle further includes at least one receptacle keying feature at a mating end of the receptacle, the receptacle keying feature being configured to mate with the plug keying feature. Upon mating of the plug with the receptacle, the receptacle and plug keying features mate with the spring biasing the coupling nut away from the receptacle. The spring thus assists in disengaging the keyed connection between the plug and receptacle.

BRIEF DESCRIPTION OF THE DRAWING

For a better understanding of the present invention, together with other objects, features and advantages, reference should be made to the following detailed description which should be read in conjunction with the following figures wherein like numerals represent like parts.

DETAILED DESCRIPTION

The present invention will now be described in connection with exemplary embodiments wherein the receptacle is adapted to mount to an instrument panel, or the like. Those skilled in the art will recognize, however, that the advantages of the invention could be incorporated into many connector designs. It is intended, therefore, that the invention not be limited to the specific embodiments described, but include any variations thereof associated with use in varied connector schemes and designs.

In one embodiment of the present invention, there is provided a connector assembly including keyed plug and receptacle portions. The plug includes a retractable coupling nut and a key that rotates relative to the coupling nut to allow threaded connection between the plug and the receptacle. The receptacle is configured to receive the key to prevent inadvertent connection of an incorrect plug with the receptacle.

Figure 1:
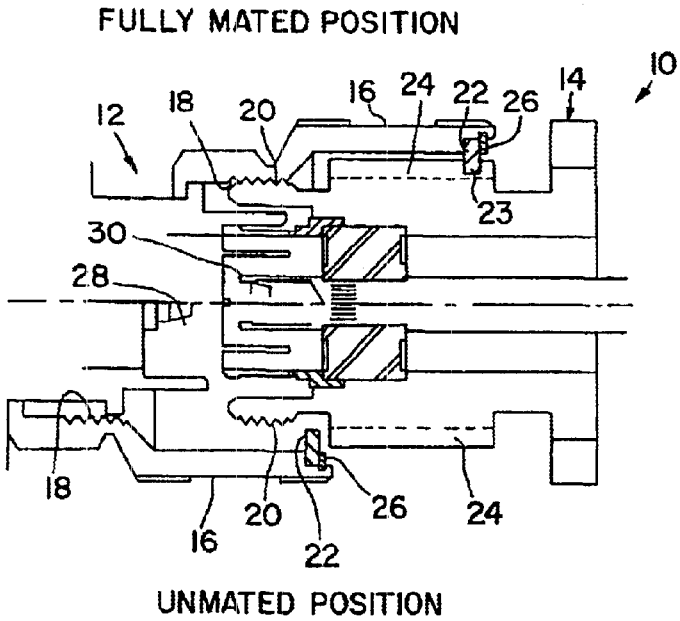
FIG. 1 is a partial sectional view of an exemplary connector assembly consistent with the invention wherein the top portion illustrates an exemplary plug and receptacle consistent with the invention in a mated position and the bottom portion illustrates the plug and receptacle in an unmated position.

Turning to FIG. 1, a partial sectional view of an exemplary connector assembly 10 consistent with the invention is illustrated, wherein the top portion illustrates an exemplary plug 12 and receptacle 14 consistent with the invention in a mated position and the bottom portion illustrates the plug 12 and receptacle 14 in an unmated position. In the illustrated exemplary embodiment, the plug portion includes a retractable coupling nut 16, which moves axially against the bias of a spring (not shown). In the top portion of FIG. 1, the coupling nut is shown in an extended position, and in the bottom portion of FIG. 1, the coupling nut is shown in a retracted position.

In the illustrated exemplary embodiment, the coupling nut 16 includes internal threads 18 for meshingly engaging corresponding exterior threads 20 on the receptacle portion. The plug also includes a key 22, which includes a projection 23 that mates with a corresponding raceway 24 in the receptacle to ensure that a plug is mated with an appropriate receptacle. In the illustrated embodiment, the key 22 is held in place on the end of the coupling nut 16 by a retainer ring 26, but is free to rotate relative to the coupling nut 16.

Figure 6:
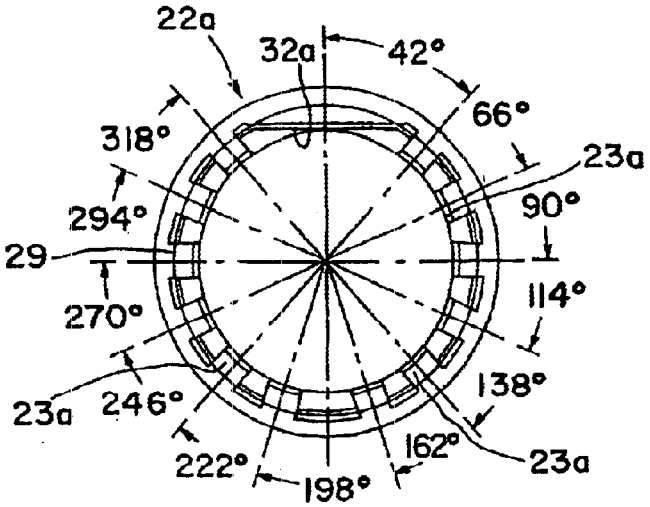
FIG. 6 is an end view of a key consistent with the invention illustrating alternative key positions.

Electrical connection between a center pin 28 on the plug and a center conductor 30 on the receptacle may be established and maintained by forcing the coupling nut axially outward in the direction of the receptacle 14 and mating projection 23 of the key 22 with the raceway 24 on the receptacle. The interior surface of the key 22 also includes a flat portion 32. The flat portion 32, as shown in FIG. 3, is aligned with a corresponding flat portion 34 of an exterior surface of an outer shell 37 of the receptacle, as shown in FIG. 6.

The plug is threaded onto the receptacle via threads 18 and 20. Mounting of the key 22 to the coupling nut to allow relative rotational movement therebetween allows the projection 23 to remain in the raceway 24 and the flat surface 32 of the key to remain aligned with the flat surface 34 on the receptacle as the coupling nut rotates onto the receptacle with meshing engagement of the threads. To remove the connection, the coupling nut 16 is rotated in an opposite direction, while the key 22 remains in the raceway 24, until the threads 18 on the coupling nut disengage from the threads 20 on the receptacle. Then, the coupling nut may move rearward with the key 22 traveling axially in the raceway 24 until it is withdrawn therefrom.

Figure 2:
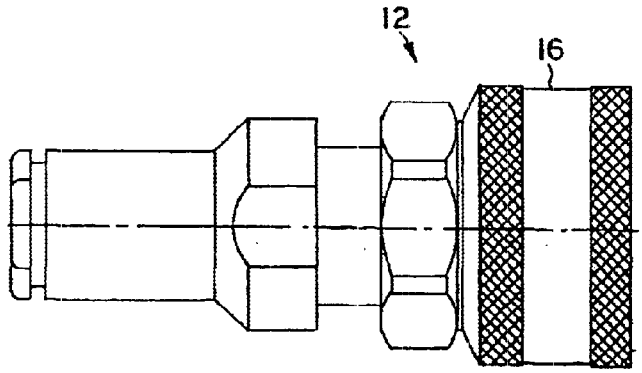
FIG. 2 is a side view of the exemplary plug illustrated in FIG. 1.
Figure 3:
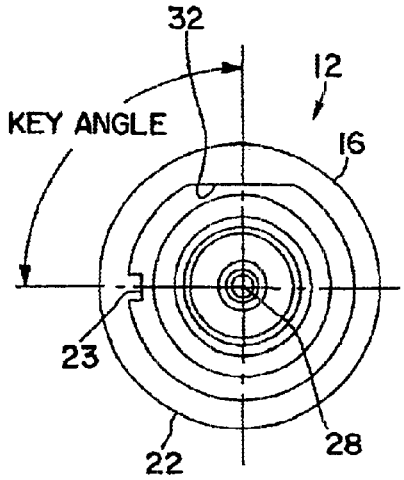
FIG. 3 is an end view of the exemplary plug illustrated in FIG. 1.
Figure 4:
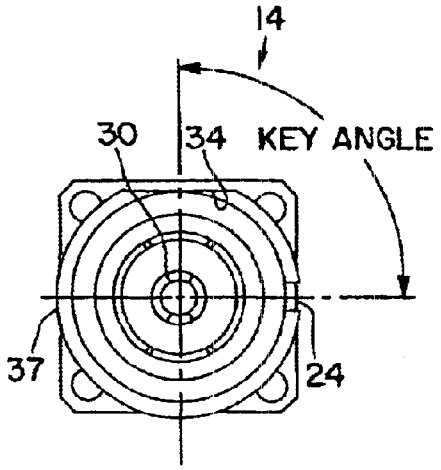
FIG. 4 is an end view of the exemplary receptacle illustrated in FIG. 1.
Figure 5:
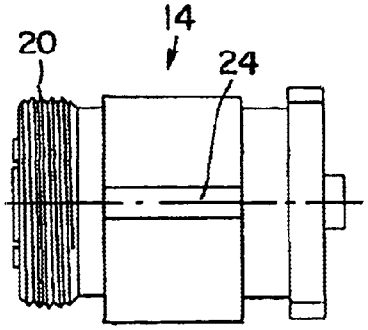
FIG. 5 is a side view of the exemplary receptacle illustrated in FIG. 1.

An exemplary plug consistent with the invention is illustrated in FIGS. 2 and 3, and an exemplary receptacle consistent with the invention is illustrated in FIGS. 4–5. As shown in FIG. 3, the flat surface 32 and the projection 23 of the key 22 define a key angle, measured in this instance from the center of the flat surface 32 to the key 22. The key angle for the plug 12 is configured to match a corresponding key angle for the receptacle.

In the exemplary embodiment illustrated in FIG. 5, the flat surface 34 on the receptacle is formed on the exterior surface of the outer shell 37. Also, the keyway for receiving the projection 23 is configured as a groove in the outer shell 37. The receptacle key angle is measured from the center of the flat surface 34 on the receptacle to the center of the raceway 24.

Although in the illustrated exemplary embodiment the projection 23 and the keyway 24 are generally rectangular in cross-section, those skilled in the art will recognize that these elements may be configured in any regular or irregular geometric shape and/or multiple keys and associated keyways may be provided. Also, the keyway need not have the same cross-sectional shape as the projection. In regard to the flat surfaces 32 and 34, the illustrated embodiment depicts only a single flat surface. It is possible, however, to provide non-flat surfaces and/or multiple flat surfaces or non-flat surfaces.

Advantageously, a variety of matching key angles for the plug and receptacle are possible. FIG. 4, for example, is an end view of a key 22*a* consistent with the invention illustrating alternative key angle positions. Each of the alternative key angle positions is measured from the flat surface 32*a* to an associated one or ones of the projections 23*a*. The key angle or angles for the key 22*a* would be established by removing material in the key, e.g. to line 29, to leave a selected one or ones of the projections 23*a* extending radially inward. The corresponding receptacle would be provided with a flat surface positioned to align with the flat surface 32*a* and a number of raceways 24 each of which configured to mate with an associated one of the projections 23*a*.

There is thus provided a connector assembly including a plug and receptacle that are keyed to one another to prevent inadvertent connection of a plug with an incorrect receptacle, which could cause damage to associated equipment. Consistent with the invention a retractable coupling nut is provided on the plug and threaded engagement of the plug to the receptacle is achieved with a key projection on a rotatable key maintained in a corresponding raceway in the receptacle. The key projection therefore maintains its position in the raceway during mating of the plug to the receptacle to allow facile withdrawal of the key from the raceway when connection between the plug and receptacle is removed.

Turning now to FIGS. 7–11, there is illustrated another exemplary embodiment 50 of a connector assembly consistent with the invention. The illustrated embodiment 50 includes keyed plug 52 and receptacle 54 portions. The plug includes a spring-biased coupling nut 56 that is keyed to mate with the corresponding key features on the receptacle to prevent inadvertent connection of an incorrect plug with the receptacle. Advantageously, the coupling nut 56 is spring biased in a direction away from the receptacle 54 to allow facile removal of the keyed connection between the plug and receptacle.

Figure 7A:
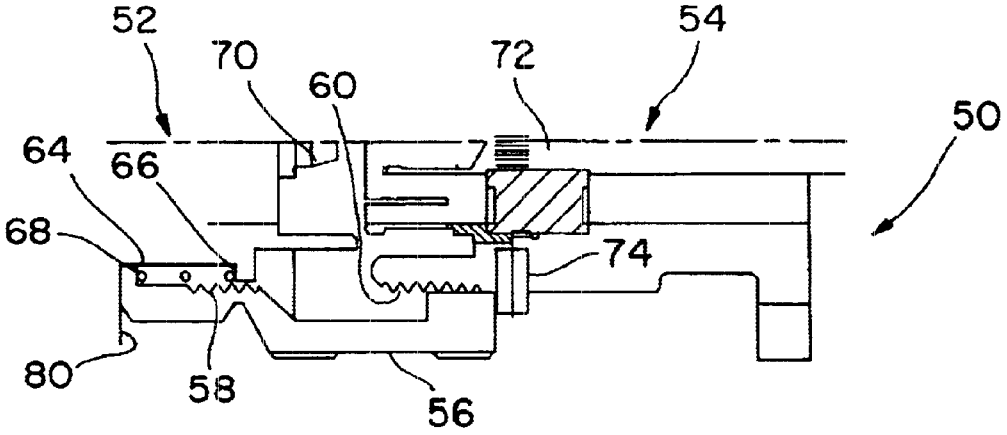
FIGS. 7A–7C are a partial sectional views of a lower half of another exemplary connector assembly consistent with the invention illustrating another exemplary plug and receptacle in successive positions from unmated to mated.
Figure 7B:
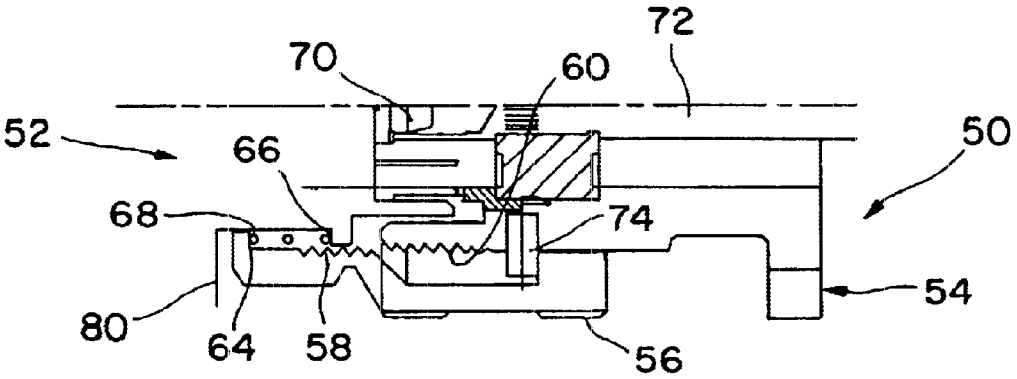
Figure 7C:
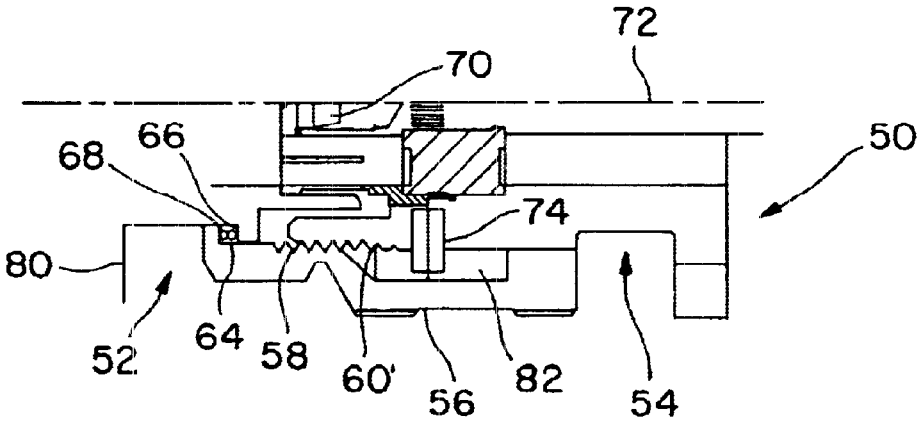
Figure 8:
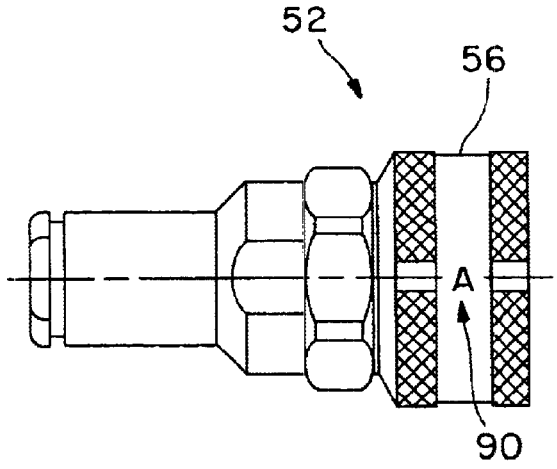
FIG. 8 is a side view of the exemplary plug illustrated in FIGS. 7A–7C.

FIGS. 7A–7C are partial sectional views of a bottom portion of the assembly 50 successively illustrating the plug 52 and receptacle 54 from unmated to fully mated positions. In particular, FIG. 7A illustrates an unmated position, FIG. 7B illustrates a partially mated position, and FIG. 7C illustrates a fully mated position. Since the top and bottom halves of the assembly are symmetrical in sectional view, the top portion of the assembly has been omitted from the sectional views in FIGS. 7A–7C for clarity.

Figure 9:
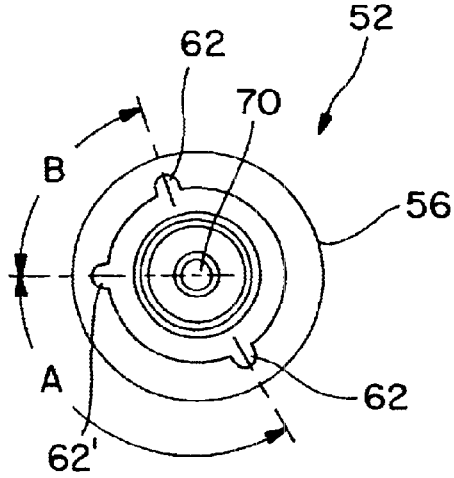
FIG. 9 is an end view of the exemplary plug illustrated in FIGS. 7A–7C.
Figure 10:
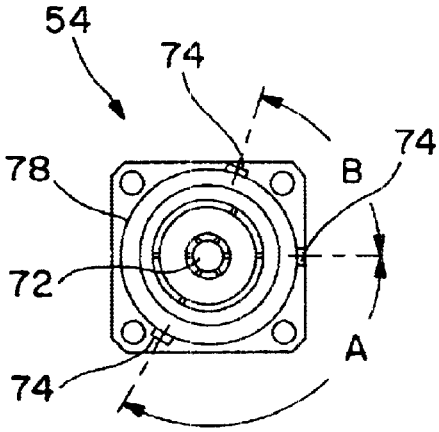
FIG. 10 is an end view of the exemplary receptacle illustrated in FIGS. 7A–7C.
Figure 11:
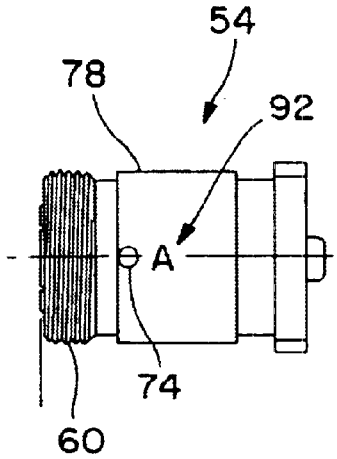
FIG. 11 is a side view of the exemplary receptacle illustrated in FIGS. 7A–7C.

In the illustrated exemplary embodiment, the coupling nut 56 includes internal threads 58 for meshingly engaging corresponding exterior threads 60 on the receptacle portion. With reference also to FIGS. 9, 10, and 11, the plug also includes a number of raceways 62 dimensioned for receiving corresponding keying projections 74 on the receptacle to form a keyed relationship between the plug and receptacle. As shown in FIGS. 10 and 11, the projections 72 may be pins extending radially from the body 78 of the plug in locations corresponding to the raceways in the coupling nut.

Advantageously, a spring 64 is provided for biasing the coupling nut 56 axially away from the receptacle 54. The spring is disposed between a shelf 66 and an opposed shelf 68 on the coupling nut. In an unmated position, the spring biases the coupling nut against a stop 80 on the plug, as shown in FIG. 7A. As will be described in greater detail below, the spring facilitates removal of the keyed connection between the plug and receptacle by biasing the coupling nut away from the receptacle.

With specific reference to FIG. 7A, electrical connection between a center pin 70 on the plug and a center conductor 72 on the receptacle is initially made by fitting the coupling nut 56 over the receptacle 54 until the coupling nut abuts the keying projections 74 on the receptacle. The coupling nut 56 is rotated until an indicating mark 90 on the plug is aligned with an indicating mark 92 on the receptacle. With this alignment, the raceways 62 on the plug and the keying projections 74 on the receptacle are aligned. If the arrangement of the raceways 62 on the plug does not match the keying projections 74 on the receptacle, the plug and receptacle do not match and cannot be mated electrically or mechanically.

The coupling nut 56 is then forced toward the receptacle 54, against the bias of the spring 64, so that the nut moves over and beyond the keying projections 74, as shown in FIG. 7B. In this position, the ends of the pins 74 may be disposed in a cavity 82 defined between the coupling nut and the plug. The coupling nut 56 may then be rotated to fully engage the mating threads 58, 60 on the plug and receptacle, as shown for example in FIG. 7C.

To remove the connection between the plug and receptacle, the coupling nut 56 is rotated to release the threaded connection. Upon disengagement of the threads 58, 60, the coupling nut will be forced away from the receptacle by the spring 64 to abut the keying projections 74. Continued rotation of the coupling nut will cause the keying projections 74 and raceways 62 to align and engage. At this point, the spring will force the coupling nut over the keying projections. The plug and receptacle are then restrained only by friction, and can be pulled apart.

Those skilled in the art will projections 74 and raceways 62 may be configured in any regular or irregular geometric shape. The projections and raceways can also be reversed in position, i.e. the projections can be placed on the coupling nut and the raceways on the plug. Also, the raceways need not have the same cross-sectional shape as the projections Key angles for the assembly may be defined by the angle from one of the keying projections or raceways to another. FIG. 9, for example, illustrates key angles A and B measured from raceway 62' for the illustrated exemplary plug. To provide a mating receptacle, corresponding angles may be made for the keying projections 74, as shown in FIG. 10. Advantageously, a variety of matching key angles for the plug and receptacle are possible.

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of this invention.

What is claimed is:

1. A connector assembly comprising:

a plug comprising a coupling nut including at least one plug keying feature at a mating end of said plug, and a spring configured for biasing said coupling nut away from said mating end of said plug; and a receptacle comprising threads for meshingly engaging corresponding threads on said plug upon mating of said plug to said receptacle, said receptacle further comprising at least one receptacle keying feature at a mating end of said receptacle, said receptacle keying feature being configured to mate with said at least one plug keying feature, whereby upon mating of said plug with said receptacle said receptacle and plug keying features mate with said spring biasing said coupling nut away from said receptacle.

2. The connector assembly of claim 1, wherein said plug keying feature comprises a raceway formed in an interior surface of said coupling nut.

3. The connector assembly of claim 2, wherein said receptacle keying feature comprises a projection extending from a body of said receptacle.

4. The connector assembly of claim 1 wherein said threads on said plug are disposed on an interior surface of said coupling nut.

5. The connector assembly of claim 4, wherein said threads on said receptacle are disposed on an exterior surface of said receptacle.

6. A plug portion of a connector assembly, said plug portion comprising:

a coupling nut including at least one plug keying feature at a mating end of said plug, and a spring configured for biasing said coupling nut away from said mating end of said plug, whereby upon mating of said plug with a corresponding receptacle said plug keying feature mates with a corresponding keying feature on said receptacle with said spring biasing said coupling nut away from said receptacle.

7. The connector assembly of claim 6, wherein said plug keying feature comprises a raceway formed in an interior surface of said coupling nut.

8. The connector assembly of claim 7, wherein said receptacle keying feature comprises a projection extending from a body of said receptacle.

9. The connector assembly of claim 6, wherein said plug comprises threads for engaging corresponding threads on said receptacle upon mating of said plug with said receptacle.

10. The connector assembly of claim 9, wherein said threads on said plug are disposed on an interior surface of said coupling nut.

11. The connector assembly of claim 10, wherein said threads on said receptacle are disposed on an exterior surface of said receptacle.

12. A connector assembly comprising:

a plug comprising a coupling nut including plug threads on an interior surface thereof and at least one raceway said coupling nut at a mating end of said plug, said plug further comprising a spring configured for biasing said coupling nut away from said mating end of said plug; and a receptacle comprising receptacle threads on an exterior surface thereof for meshingly engaging said plug threads upon mating of said plug to said receptacle, said receptacle further comprising at least one keying projection at a mating end of said receptacle, said keying projection configured to mate with said at least one raceway, whereby upon mating of said plug with said receptacle said keying projection and said raceway mate with said spring biasing said coupling nut away from said receptacle.

* * * * *